United States Patent [19]

Pilcher

[11] Patent Number: 4,574,030

[45] Date of Patent: Mar. 4, 1986

[54] APPARATUS FOR DISPENSING TAPE HAVING A PROTECTIVE BACKING

[76] Inventor: Henry D. Pilcher, 123 N. Pointe Dr., Auburndale, Fla. 33823

[21] Appl. No.: 571,362

[22] Filed: Jan. 16, 1984

[51] Int. Cl.[4] ..... B32B 31/18

[52] U.S. Cl. ..... 156/522; 156/523; 156/527; 156/540; 156/577; 156/579; 156/584

[58] Field of Search ..... 156/250, 256, 522, 523, 156/574, 577, 579, 527, 540, 584; 225/24, 26

[56] References Cited

U.S. PATENT DOCUMENTS

| | | | |
|---|---|---|---|
| 361,225 | 4/1887 | Kunkle | 156/540 |
| 3,136,462 | 6/1964 | Knutson | 225/24 |
| 3,453,660 | 7/1969 | Gehweiler | 156/584 |
| 3,715,262 | 2/1973 | Kelly | 156/577 |
| 4,096,022 | 6/1978 | Crawford | 156/584 |
| 4,253,905 | 3/1981 | Regan | 156/577 |

*Primary Examiner*—Caleb Weston

*Attorney, Agent, or Firm*—Macdonald J. Wiggins

[57] ABSTRACT

A portable dispenser for adhesively-coated tape having a protective backing, such as duct tape, includes a frame and means on the frame for rotatably supporting a tape reel. A rub-out bar on the frame urges the tape against the surface to which the tape is to be fixed, and a take-up reel is biased into contact with the dispensing reel for simultaneously pulling away and taking up the protective backing from the tape being dispensed.

8 Claims, 2 Drawing Figures

APPARATUS FOR DISPENSING TAPE HAVING A PROTECTIVE BACKING

BACKGROUND OF THE INVENTION

1. Field of the Invention

The present invention relates generally to the dispensing art, and particularly relates to a class of portable dispensers for adhesively-coated tapes and particularly of the type having a protective backing, such as duct tape.

2. Description of the Prior Art

In the installation of air-handling equipment such as air conditioners and heaters, specialists in this field are typically required to custom-manufacture air-handling ducts which move the air from the heater or air conditioner to different parts of a building. This duct work usually consists of a fiberglass insulative material having an outer aluminum foil surface. In order to make a joint between adjacent "runs" of duct material and to seal corners of ducts, it is customary to use a class of adhesively-coated tapes known as "duct tape." This type of tape usually consists of a rather stiff aluminum foil having the adhesive on one side, and with a waxed paper or similar material forming a protective coating over the adhesive until such time as the protective backing is removed for installation. These types of rather high quality tapes are required in order to ensure a leakproof duct.

However, thin metallic tapes of this type are difficult to handle, and the difficulty with such tapes is magnified in the close quarters where such duct work is customarily installed (i.e. in the crawl space for a single family residence, for example). Additionally, where a large quantity of tape is used, the large amount of waste backing paper presents clean up problems.

The prior art discloses a variety of tape dispensers. Examples of such arrangements are contained in the following U.S. Pats. Nos.: 4,240,867 to Diegel; 3,186,892 to Walthers; 3,136,462 to Knutson; 1,344,427 to Moscini; 1,136,497 to Swallow; and 1,029,308 to Merwin, et al. However, prior art dispensers, including those of the type disclosed in the above patents, do not lend themselves to use in dispensing duct tape in the environment discussed above.

SUMMARY OF THE INVENTION

The present invention contemplates both a portable apparatus and a related method for dispensing an adhesively-coated tape or the like of the type having a protective backing, and particularly duct tape.

The portable dispenser apparatus includes a frame defining a dispensing opening, and a reel of an adhesively-coated tape having a protective backing with means on the frame spaced from the dispensing opening for rotatably supporting the dispensing reel. Rub-out means on the frame are provided for urging the tape against a surface to which the tape is to be fixed as the tape passes along a directed path through the dispensing opening. Means are further provided for pulling away and taking up the protective backing from the tape as the tape is taken off the dispensing reel.

In accordance with a preferred embodiment of the present invention, the pulling away and taking up means comprises a take-up roller supported by the frame, with means for urging the take-up roller toward the tape reel. In a specific embodiment of the present invention, the urging means comprises means effecting contact between the outer periphery of the take-up roller and the tape reel, whereby frictional contact therebetween effectuates rotation of the take-up roller. In one example, the urging means comprises a pair of springs on the opposite side of a swing arm rotatably supporting the take-up roller.

The portable nature of the apparatus of the present invention is rendered more facile by the provision of a forward handle which comprises the means by which the swing arm for the take-up roller is supported. A rearward handle further facilitates portability and use of the apparatus.

Further in accordance with the present invention, the apparatus is provided with a cutting mechanism, preferably "downstream" of the rub-out means, for permitting the severing of the tape after dispensing and after the rubbing of the tape onto the surface to which it is being affixed.

In the operation of the apparatus, the rotation of the take-up roller with the dispensing reel permits the gathering of the protective backing after the tape is removed from the dispensing reel, thus precluding the difficulties previously experienced with respect to duct tape. Heretofore, the stripping of the protective backing often caused difficulties for the duct work installer, and precluded an even and airtight dispensing of the tape onto the abutting sections of ductwork. The apparatus and method of the present invention permits the duct tape to be dispensed while the protective backing is being removed, all within a highly compact and portable unit.

DETAILED DESCRIPTION OF THE PREFERRED EMBODIMENT

Figure 1:
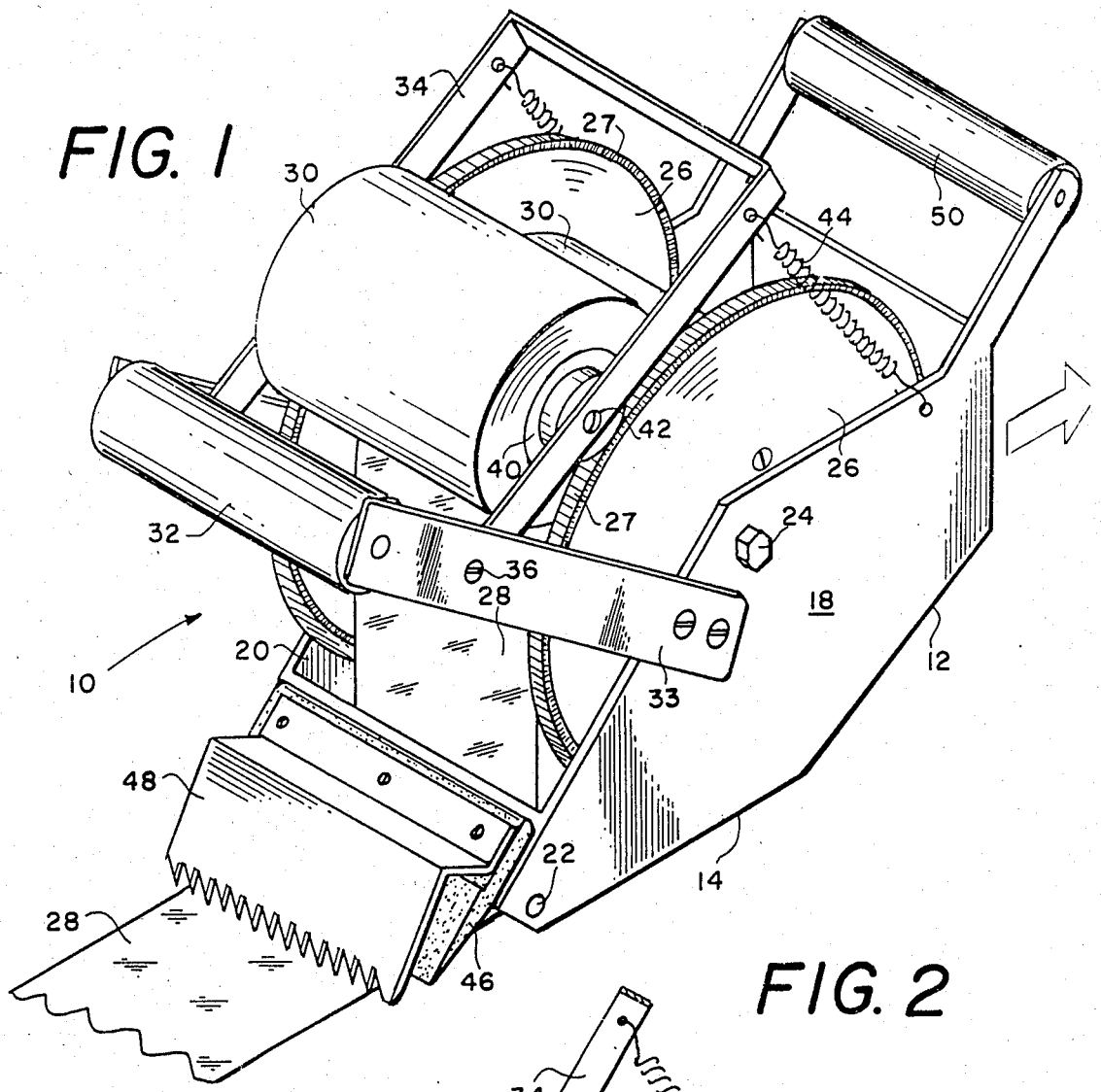
FIG. 1 is a perspective front view illustrating the dispensing apparatus of the present invention.

A preferred embodiment of the apparatus in accordance with the present invention will now be described with reference to FIGS. 1 and 2.

Figure 2:
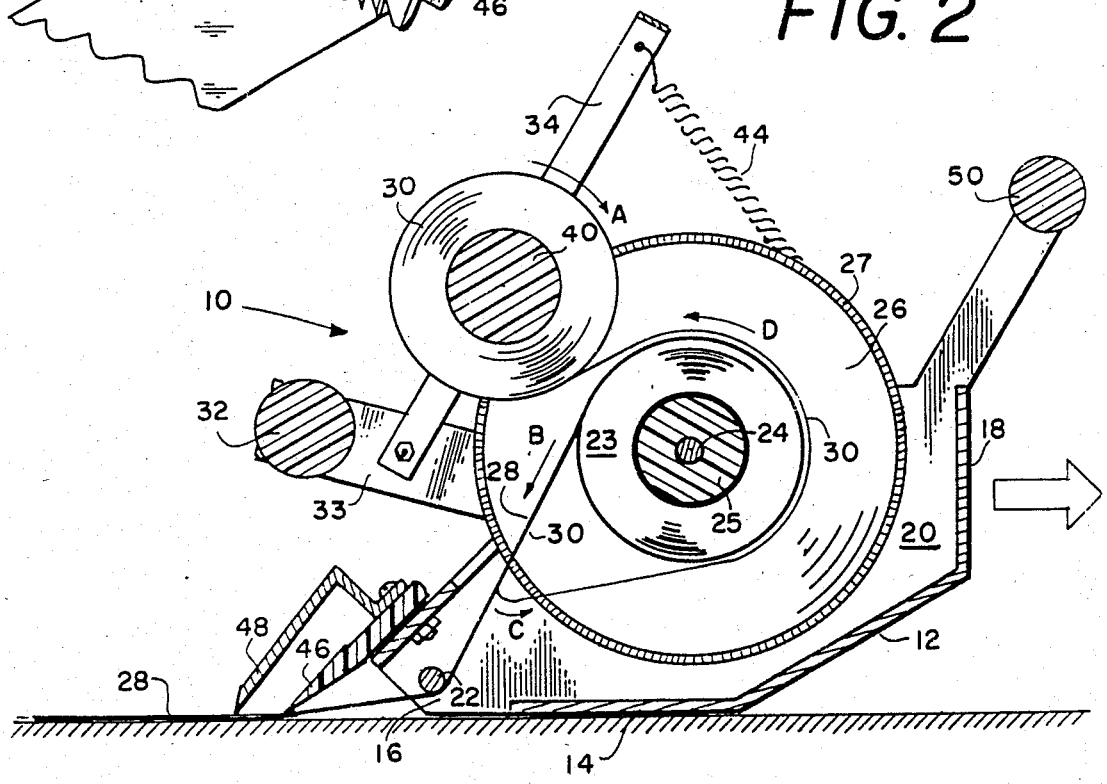
FIG. 2 is a cross-sectional view of a side elevation illustrating the dispensing apparatus of the present invention.

The tape dispenser, referred to generally by the reference numeral 10 includes a frame 12 formed of a relatively flat base 14 having a dispensing opening 16 therein but seen in FIG. 2. The frame 12 is further defined by a pair of opposed and parallel panels 18, 20 which extend generally normal to the base 14. A dispensing roller 22 is positioned in the mouth of the dispensing opening 16 and is adapted to provide a low friction contact for the non-adhesive side of the tape, described in greater detail below.

A rod or bolt 24 extends between the opposing plates 18, 20 and supports a dispensing reel 26 having an adhesive-coated metallic foil tape 28 with a protective backing 30 thereon. A handle 32 is affixed between the opposing plates 18, 20 and has a U-shaped swing arm 34 rotatably pinned thereto at points 36 and 38. A take-up roller 40 is supported by a rod or bolt 42 between the sections of the U-shaped swing arm 34, the take-up roller 40 being adapted to receive the protective backing 30 as it is stripped away from the tape 28 being dispensed from the reel 26. A roll of tape 23 is installed on a core 25 by removing rod 24 and side of reel 26.

A pair of springs 44, each on opposite sides of the U-shaped swing arm 34 and at the extremity thereof, urges the take-up roller 40 toward the dispensing reel 26, such that the roller 40 outside of the protective backing 30 comes into frictional contact with the rubber pad 27 around the periphery of the sides of the reel 26 to thereby effectuate simultaneous rotation of the take-up roller 40 with the dispensing reel 26.

The dispensing mechanism 10 is further provided with a rub-out plate 46 affixed downstream from the dispensing opening 16, and which comes in contact with the tape 28 to rub the tape against the surface to which the tape is being applied. Preferably, the rub-out is formed of a low friction plastic material, such as nylon.

A cutter bar 48 is affixed with the rub-out mechanism 46, and permits the severing of the tape by an upward rotation of the entire mechanism and a pushing downwardly on the tape 28.

A back handle 50 is also provided.

In use, the operator initially extends the tape downwardly across the surface to be taped, and then grips the portable dispenser 10 at the forward and back handles 32, 50. The dispenser 10 is then drawn along the surface to be taped in the direction of the solid arrow in the cross-sectional view in FIG. 2. As the tape 28 with backing 30 leaves the roll 23 as indicated by arrow B, the backing is removed as indicated by arrow C. As may be noted from FIG. 2, backing 30 is fed around the roll of tape 23 and gathered on roller 40 or indicated by arrow D. Roller 40 rotates in the opposite direction as shown by arrow A causing the backing to be collected on roller 40. It is to be understood that the spacing between backing 30 and the periphery of the roll of tape of FIG. 2 is to illustrate the path of backing 30 and in actuality is in contact therewith. Thus, the backing 30 is automatically removed and gathered on the roller 40 while the tape is being dispensed across the surface. The tape 28 is fed through opening 16 by roller 22. The rub-out plate 46 smooths and adheres the tape to the surface in a complete binding thereto, and upon completion of the taping operation, the tape can be severed by use of the cutter bar 48 or with a knife.

I claim:

1. A portable dispenser for adhesively-coated tape or the like of the type having a protective backing, said dispenser comprising:

(a) a frame having opposing and generally parallel panels, said frame defining a dispensing opening;

(b) a dispensing reel of an adhesively-coated tape having a protective backing;

(c) a rod for supporting said dispensing reel between said opposing panels spaced from said dispensing opening for rotatably supporting said reel;

(d) rub-out means on said frame for urging said tape against a surface to which said tape is to be affixed as said tape passes along a directed path through said dispensing opening;

(e) a take-up roller supported by said frame;

(f) a forward handle affixed to said panels and extending beyond said dispensing reel;

(g) a swing arm rotatably pinned at one end to said handle and supporting said take-up roller; and (h) means at the other end of said swing arm for biasing said take-up roller toward said dispensing reel.

2. The dispensing apparatus recited in claim 1 wherein said biasing means comprises at least one spring.

3. The dispensing apparatus recited in claim 2 further comprising friction pads across the outer surface of said reel.

4. Portable dispensing apparatus for tape or the like of the type having a protective backing, said apparatus comprising:

(a) a frame adapted to be hand-held;

(b) a dispensing roller supported by said frame for holding a roll of said tape of the type having a protective backing thereon;

(c) a take-up roller supported by said frame for receiving said protective backing; and (d) means for urging said take-up roller toward said dispensing reel, whereby the outer periphery of said take-up roller is in frictional contact with said dispensing reel for rotating said take-up roller with said dispensing reel to permit the gathering of said protective backing after said tape is removed from said dispensing reel.

5. Portable dispensing apparatus as recited in claim 4 wherein said urging means comprises:

(a) a swing arm; and (b) means at one end of said swing arm for biasing said take-up roller toward said dispensing reel.

6. A portable apparatus for dispensing tape which has an adhesively-coated side thereof and a protective backing onto a surface, said tape provided in rolls, said apparatus comprising:

a frame having a base portion having a tape-dispensing opening therethrough;

a reel disposed in said frame, said reel having a core supporting a roll of said tape, and a pair of reel sides having said roll supported therebetween;

a pair of swinging arms attached to said frame and a pair of biasing springs;

a backing take-up roller supported between said swinging arms, said biasing springs serving to urge said arms toward said reel thereby causing said roller to contact the periphery of said reel sides for causing said roller to rotate when said reel rotates, said backing of tape attached to said roller whereby said roller pulls said backing away from said tape as said roller rotates; and a rubout device disposed adjacent said opening and contacting a non-adhesive side of said tape to force said tape against a surface as said frame is moved along such surface.

7. The apparatus as defined in claim 6 which further comprises a low friction roller in said tape-dispensing opening for engagement with said non-adhesive side of said tape during dispensing thereof.

8. The apparatus as defined in claim 6 which further comprises means adjacent said tape-dispensing opening for cutting said tape after dispensing.

* * * * *